US010730303B2

(12) United States Patent
Kuramoto et al.

(10) Patent No.: US 10,730,303 B2
(45) Date of Patent: Aug. 4, 2020

(54) LIQUID EJECTING HEAD AND LIQUID EJECTING APPARATUS

(71) Applicant: SEIKO EPSON CORPORATION, Tokyo (JP)

(72) Inventors: Yasunori Kuramoto, Matsumoto (JP); Yukimasa Ishida, Shiojiri (JP); Manabu Hanakawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/171,189

(22) Filed: Oct. 25, 2018

(65) Prior Publication Data

US 2019/0126622 A1 May 2, 2019

(30) Foreign Application Priority Data

Oct. 26, 2017 (JP) ..... 2017-206900

(51) Int. Cl.
*B41J 2/14* (2006.01)
*B41J 2/165* (2006.01)

(52) U.S. Cl.
CPC ..... *B41J 2/16535* (2013.01); *B41J 2/1433* (2013.01); *B41J 2/14233* (2013.01); *B41J 2/16538* (2013.01); *B41J 2002/14241* (2013.01); *B41J 2002/14362* (2013.01); *B41J 2002/14419* (2013.01); *B41J 2002/16502* (2013.01)

(58) Field of Classification Search
CPC .. B41J 2/16535; B41J 2/16538; B41J 2/1433; B41J 2002/16502; B41J 2002/14362; B41J 2/16541; B41J 2/16544; B41J 2/16547; B41J 2002/1655; B41J 2002/16558; B41J 2/162; B41J 2002/14475
See application file for complete search history.

(56) References Cited

U.S. PATENT DOCUMENTS

| | | | |
|---|---|---|---|
| 5,798,778 | A | 8/1998 | Kimura et al. |
| 5,949,454 | A | 9/1999 | Nozawa et al. |
| 9,724,925 | B2 | 8/2017 | Nawano et al. |
| 2016/0347068 | A1 | 12/2016 | Nawano et al. |

FOREIGN PATENT DOCUMENTS

| | | | |
|---|---|---|---|
| JP | 06-122210 | A | 5/1994 |
| JP | 06-210859 | A | 8/1994 |
| JP | 07-17062 | A | 1/1995 |
| JP | 07-276620 | A | 10/1995 |
| JP | 2002-331678 | A | 11/2002 |
| JP | 2007-125714 | A | 5/2007 |
| JP | 2007-301951 | A | 11/2007 |
| JP | 2015-98093 | A | 5/2015 |
| JP | 2015-147358 | A | 8/2015 |
| JP | 2016-221777 | A | 12/2016 |

*Primary Examiner* — Kristal Feggins
(74) *Attorney, Agent, or Firm* — Workman Nydegger

(57) ABSTRACT

A liquid ejecting head having a plurality of nozzles ejecting a liquid toward a medium, the head includes a first region including the plurality of nozzles and a second region surrounding the first region, the first and second regions being provided in a portion of the liquid ejecting head opposed to the medium in which the second region has an inhibiting portion inhibiting a movement of the liquid.

12 Claims, 9 Drawing Sheets

LIQUID EJECTING HEAD AND LIQUID EJECTING APPARATUS

BACKGROUND

1. Technical Field

The present invention relates to a liquid ejecting head such as an ink jet type recording head, and a liquid ejecting apparatus.

2. Related Art

A liquid ejecting apparatus is provided with a liquid ejecting head and is an apparatus that ejects (sprays) various liquids from this liquid ejecting head. As a representative example of the liquid ejecting apparatus, for example, an image recording apparatus such as an ink jet type recording apparatus (hereinafter, simply referred to as printer) provided with an ink jet type recording head (hereinafter, simply referred to as recording head) as a liquid ejecting head and which performs recording of an image or the like by ejecting and landing a liquid ink as a droplet onto a medium such as a recording paper as a liquid landing object from the recording head to form a dot can be mentioned. In recent years, the liquid ejecting apparatus has been applied not only to image recording apparatuses but also to various manufacturing apparatuses such as display manufacturing apparatuses, for example.

In the liquid ejecting apparatus equipped with the liquid ejecting head, liquid may adhere to a nozzle surface due to factors such as more minute mist being generated as liquid is ejected from a nozzle. Therefore, such a liquid ejecting apparatus is provided with a wiping mechanism wiping the nozzle surface in order to remove liquid or other foreign matter adhered to the nozzle surface. For example, in JP-A-2016-221777, a wiping unit provided with a wiper as the wiping mechanism wiping the nozzle surface of a nozzle plate of a droplet ejecting head is provided. In the configuration of JP-A-2016-221777, the nozzle is wiped after the wiper has wiped a recessed portion formed by a step formed between the nozzle plate and a cover (fixing plate) provided around the nozzle plate in a state where the recessed portion is filled with the liquid. Therefore, it is suppressed that a thickened liquid adhered to the nozzle surface is melted and the thickened liquid is rubbed into the nozzle.

In the above configuration, there is a possibility that the liquid accumulated in the recessed portion is rubbed into the nozzle. In a case where a different type of liquid from the liquid ejected from the nozzle is adhered to the nozzle surface, the liquids are mixed with each other in the recessed portion, and there is a possibility that the mixed liquid is rubbed by the wiper. When the mixed liquid is rubbed by the wiper, for example, in a printer which is a type of liquid ejecting apparatus, color mixture in which inks of different colors are mixed is generated, and as a result, there is a possibility that image quality of a recorded image recorded on the medium is deteriorated. In order to discharge such a mixed liquid from the nozzle, it is necessary to perform a cleaning operation forcibly discharging the liquid from the nozzle, so that there is a problem of extra consumption of liquid by that amount.

SUMMARY

An advantage of some aspects of the invention is to provide a liquid ejecting head and a liquid ejecting apparatus capable of reducing liquid consumption by a cleaning operation.

According to an aspect of the invention, there is provided a liquid ejecting head in which a plurality of nozzles ejecting a liquid toward a medium are arranged in parallel, the head including a first region including the plurality of nozzles and a second region surrounding the first region, the first and second regions being provided in a portion of the liquid ejecting head opposed to the medium in which the second region has an inhibiting portion inhibiting a movement of the liquid.

With this configuration, since the second region adjacent to the first region including the nozzle has the inhibiting portion which inhibits the movement of the liquid at the portion of the liquid ejecting head opposed to the medium, the movement of the liquid (adhered liquid) adhered to the portion of the liquid ejecting head opposed to the medium is suppressed by the inhibiting portion. In this manner, the adhered liquid is suppressed from rubbing into the nozzle during a wiping operation in which the portion of the liquid ejecting head opposed to the medium is wiped by a wiping member. As a result, it is possible to reduce the amount of liquid consumption required for discharging the adhered liquid from the nozzle in a cleaning operation.

In the liquid ejecting head, the first region may have a plurality of nozzle groups corresponding to each of a plurality of different liquids, and may be divided into a plurality of nozzle group regions including the nozzle groups by the inhibiting portion.

With this configuration, since the first region is divided into the plurality of nozzle group regions corresponding to each nozzle group by the inhibiting portion, the movement of the liquid between the nozzle group regions is suppressed by the inhibiting portion. In this manner, since it is suppressed that a mixed liquid in which different adhered liquids are mixed in each nozzle group region is generated, the mixed liquid is suppressed from rubbing into the nozzle during the wiping operation in which the portion of the liquid ejecting head opposed to the medium is wiped by the wiping member. As a result, it is possible to reduce the amount of liquid consumption required for discharging the mixed liquid from the nozzle in the cleaning operation.

In addition, in the liquid ejecting head, it is preferable that each of the nozzle groups be assigned with each of the liquids having different brightness among the plurality of different liquids, and among the plurality of nozzle group regions, the nozzle group region which includes the nozzle group corresponding to the liquid having a highest brightness and the nozzle group region which includes the nozzle group corresponding to the liquid having a lowest brightness be not adjacent to each other in a first direction where the nozzles are arranged in parallel and in a second direction orthogonal to the first direction where the nozzles are arranged in parallel.

With this configuration, since the nozzle group region of the nozzle group corresponding to the liquid having a highest brightness and the nozzle group region of the nozzle group corresponding to the liquid having a lowest brightness are not adjacent to each other in the direction where the nozzles are arranged in parallel and in the direction orthogonal to the direction where the nozzles are arranged in parallel, mixing of the liquid having the highest brightness and the liquid having the lowest brightness, which is a combination likely to be particularly conspicuous when mixing, is suppressed. In this manner, it is possible to reduce the amount of liquid consumption required for discharging the mixed liquid from the nozzle in the cleaning operation.

In the liquid ejecting head, the inhibiting portion may be located between adjacent nozzle group regions.

With this configuration, since the inhibiting portion is provided between the adjacent nozzle group regions, the path along a boundary between the different regions which can be the liquid moving path between the nozzle group regions is extended, so that the movement of the liquid between the nozzle group regions is more effectively suppressed.

In addition, in the liquid ejecting head, it is preferable that the inhibiting portion protrude toward the medium side from the first region.

With this configuration, since the inhibiting portion protrudes toward the medium side from the surface of the first region, it is a barrier against the liquid and the movement of the liquid beyond the inhibiting portion is suppressed.

In the liquid ejecting head, it is preferable that the inhibiting portion have a liquid repellent property.

With this configuration, since the liquid is repelled at the inhibiting portion, it is further suppressed that the liquid moves beyond the inhibiting portion to the other nozzle group region.

In the liquid ejecting head, it is preferable that the liquid repellent property of the inhibiting portion be higher than a liquid repellent property of the second region and lower than a liquid repellent property of the first region.

With this configuration, the liquid on the second region side is suppressed from moving toward the first region while suppressing the movement of the liquid due to the liquid repellent property of the inhibiting portion.

In addition, the liquid ejecting head further may include a nozzle plate on which the plurality of nozzles are arranged in parallel, and an outer peripheral member surrounding the nozzle plate, in which the second region may be a filling material filled in a gap between the nozzle plate and the outer peripheral member, and the inhibiting portion may be a portion of the filling material extending from an outside of the nozzle plate to the first region of the nozzle plate.

With this configuration, since the inhibiting portion can be formed in the step of filling the gap between the nozzle plate and the outer peripheral member with the filling material, there is no need to separately provide a step of forming the inhibiting portion.

Alternatively, the liquid ejecting head further may include a nozzle plate on which the plurality of nozzles are arranged in parallel, and an outer peripheral member surrounding the nozzle plate, in which the inhibiting portion may be a portion of the outer peripheral member extending from the outside of the nozzle plate to the first region of the nozzle plate.

With this configuration, since a portion of the outer peripheral member can function as the inhibiting portion, there is no need to separately provide the inhibiting portion.

In the liquid ejecting head, it is preferable that a portion of the outer peripheral member be fixed to the first region with an adhesive, and the adhesive extend from a bonding region between a portion of the outer peripheral member and the first region to an outside of the bonding region.

With this configuration, since the adhesive extends from the bonding region between a portion of the outer peripheral member and the first region to the outside of the bonding region, the liquid is further suppressed from passing through the bonding region between a portion of the outer peripheral member and the first region.

In the liquid ejecting head, it is preferable that surface roughening be performed on a surface of a portion of the outer peripheral member.

With this configuration, since the surface of a portion of the outer peripheral member is a rough surface, the liquid repellent property can be further enhanced. In this manner, it is further suppressed that the liquid moves beyond a portion of the outer peripheral member to the other nozzle group region.

In addition, in the liquid ejecting head, it is preferable that a region of the nozzle plate corresponding to the first region has a liquid repellent film, and a region of the nozzle plate corresponding to the inhibiting portion does not have the liquid repellent film.

With this configuration, it is possible to fix the region corresponding to the inhibiting portion on the nozzle plate. In this manner, the region corresponding to the inhibiting portion is suppressed from falling off from the nozzle plate.

According to another aspect of the invention, a liquid ejecting apparatus includes the liquid ejecting head of any one of the configurations described above, and a wiping mechanism wiping a portion of the liquid ejecting head opposed to the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments to perform the invention will be described with reference to the drawings. In the embodiments described below, although various limitations are made as preferred specific examples of the invention, the scope of the invention is not limited to these embodiments unless there is a description specifically to limit the invention in the following description. In the embodiment, an image recording apparatus which is an aspect of a liquid ejecting apparatus, specifically, an ink jet type printer (hereinafter, referred to as printer) equipped with an ink jet type recording head (hereinafter, simply referred to as recording head) as a liquid ejecting head will be described as an example.

Figure 1:
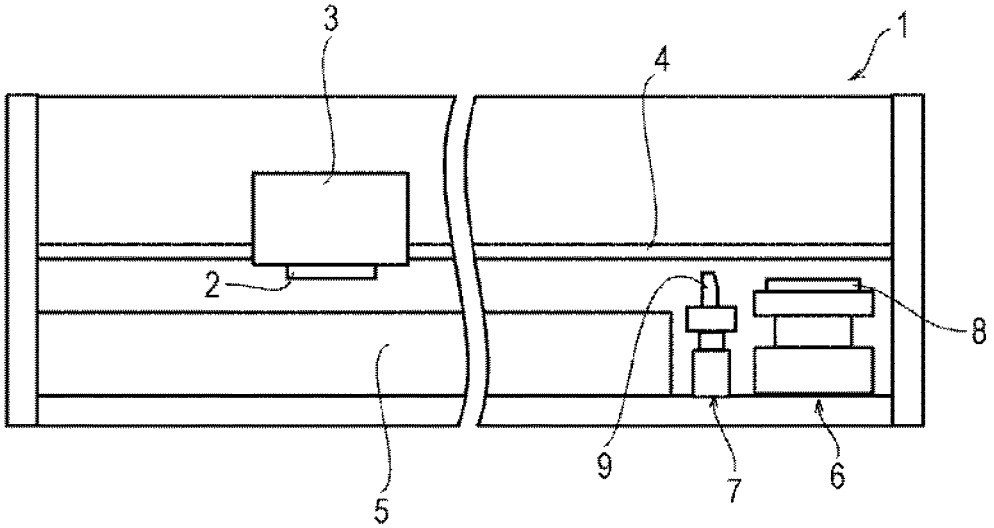
FIG. 1 is a front view showing a configuration of an aspect of a liquid ejecting apparatus (printer).
Figure 2:
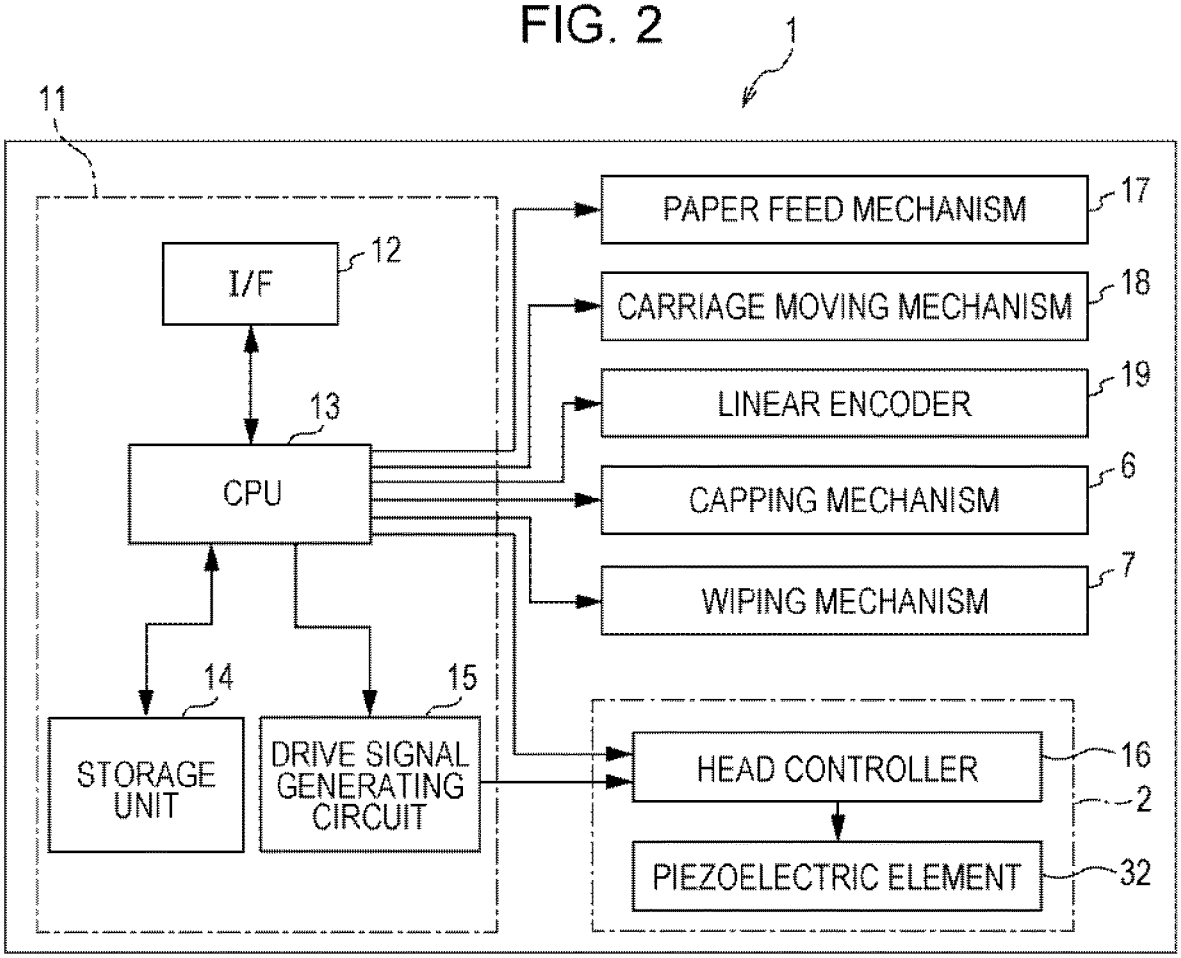
FIG. 2 is a block diagram showing an electrical configuration of the liquid ejecting apparatus.

FIG. 1 is a front view showing a configuration of a printer 1, and FIG. 2 is a block diagram showing an electrical configuration of the printer 1. A recording head 2, which is a type of the liquid ejecting head, is attached to a bottom side of a carriage 3 equipped with an ink cartridge (liquid supply source). The carriage 3 is configured to be able to reciprocate along a guide rod 4 by a carriage moving mechanism 18. That is, the printer 1 sequentially transports a medium onto a platen 5 by a paper feed mechanism 17, ejects ink which is a type of liquids in the invention from a nozzles 30 (refer to FIGS. 4 and 5) of the recording head 2 while relatively moving the recording head 2 in a width direction (main scanning direction) of the medium, and causes the ink to land on a recording surface of the medium (recording medium, liquid landing object) such as recording paper so as to record and print an image or the like. A configuration in which the ink cartridge is disposed on the main body side of the printer and ink of the ink cartridge is fed to the recording head 2 side through a supply tube can be adopted.

In the printer 1 in the embodiment, inks of a plurality of types, for example, of a plurality of colors are ejected from the nozzle 30 of the recording head 2. More specifically, inks in total of four colors of black (Bk), cyan (Cy), magenta (Ma), and yellow (Ye) are used in the printer 1. As the ink, a coloring material or one containing a solvent for dispersing or dissolving the coloring material is used. The coloring material is, for example, a pigment and azo pigment such as insoluble azo pigment, condensed azo pigments, azo lake, and chelate azo pigment, polycyclic pigment such as phthalocyanine pigment, perylene and perinone pigment, anthraquinone pigment, quinacridone pigments, dioxane pigment, thioindigo pigment, isoindolinone pigment, and quinophthalone pigment, dye chelate, dye lake, nitro pigments, nitroso pigments, aniline black, daylight fluorescent pigment, carbon black, base metal pigment, and the like can be used. Furthermore, as the pigment, inorganic materials (black pigment) such as copper oxide and manganese dioxide, and inorganic materials such as zinc white, titanium oxide, antimony white, zinc sulfide, and the like can be used. In addition, as the dye, direct dye, acidic dye, food dye, basic dye, reactive dye, disperse dye, vat dye, soluble vat dye, reactive disperse dye, and the like can be used. As a solvent of aqueous ink, pure water or ultrapure water such as ion exchange water, ultrafiltration water, reverse osmosis water, distilled water, or the like can be used. As a solvent of oil-based ink, one containing a volatile organic solvent such as ethylene glycol or propylene glycol can be used. Furthermore, the ink may contain a basic catalyst, a surfactant, a tertiary amine, thermoplastic resin, pH adjusting agent, buffer solution, fixing agent, antiseptic, antioxidant and ultraviolet absorber, chelating agent, oxygen absorber or the like, in addition to the above-described coloring material and solvent.

In an inside of the printer 1, a home position, which is a standby position of the recording head 2, is set at a position deviated from the platen 5 on one end side in the main scanning direction (right side in FIG. 1). In the home position, a capping mechanism 6 (a type of sealing mechanism) and a wiping mechanism 7 (a type of wiping mechanism) are provided in order from one end side. The capping mechanism 6 has a cap 8 (a type of sealing member) made of an elastic member such as an elastomer, for example, and is configured to be capable of converting the cap 8 into a sealed state (capping state) by bringing the cap 8 into contact with a nozzle surface 23 of the recording head 2 or a retracted state separated from the nozzle surface 23. In the capping mechanism 6, a space in the cap 8 functions as a sealed empty portion, and the nozzle surface 23 is sealed in a state where the nozzle 30 of the recording head 2 faces the sealed empty portion. In addition, a pump unit (suction mechanism) not shown is connected to the capping mechanism 6, and the pressure inside the sealed empty portion can be made negative by an operation of the pump unit. In the suction operation (cleaning operation), when the pump unit is operated in a state of close contact with the nozzle surface 23 and the pressure inside the sealed empty portion is made negative, ink or air bubbles in the recording head 2 are sucked from the nozzle 30 and discharged into the sealed empty portion of the cap 8.

The wiping mechanism 7 in the embodiment has a wiper 9 (a type of wiping member), and the wiper 9 is made of a member having elasticity and flexibility such as rubber, elastomer, or the like. In the wiping mechanism 7, the wiper 9 is disposed at a position where a leading end portion thereof can be in contact with the nozzle surface of the recording head 2 during wiping. The nozzle surface is wiped by the wiper 9 by relatively moving both in a state where the leading end portion of the wiper 9 is in contact with the nozzle surface. In the wiping operation in the embodiment, the wiper 9 and the nozzle surface relatively move in a direction intersecting (orthogonal) to a nozzle row direction. As the wiping mechanism 7, a cloth such as a woven fabric, a knitted fabric, a nonwoven fabric, or the like, that is, a wiper configured to wipe by sliding a sheet-like wiper on the nozzle surface, can be adopted.

In the printer 1 in the embodiment, each part is controlled by a printer controller 11. The printer controller 11 in the embodiment includes an interface (I/F) unit 12, a CPU 13, a storage unit 14, and a drive signal generating circuit 15. The interface unit 12 receives print data or a print instruction from an external device such as a computer or a portable information terminal, and outputs the state information of the printer 1 to the external device. The storage unit 14 is an element that stores programs of the CPU 13 and data used for various controls, and includes ROM, RAM, and non-volatile storage element (NVRAM).

The CPU 13 controls each unit according to a program stored in the storage unit 14. In addition, the CPU 13 in the embodiment generates ejection data indicating whether to eject ink in an amount (weight or volume) corresponding to which dot size at which timing from which nozzle 30 of the recording head 2 at the time of recording operation, based on print data from the external device or the like, and transmits the ejection data to a head controller 16 of the recording head 2. In addition, the CPU 13 generates a timing signal such as a latch signal LAT from encoder pulses output from a linear encoder, and outputs the timing signal to the head controller 16 of the recording head 2. The head controller 16 selectively applies a drive pulse in the drive signal to a piezoelectric element 32 (refer to FIG. 4) based on the ejection data and the timing signal. In this manner, the piezoelectric element 32 is driven so that ink droplets are ejected from the nozzles 30, or a fine vibration operation is performed to such an extent that ink droplets are not ejected. The drive signal generating circuit 15 generates the drive signal including the drive pulse for ejecting ink droplets to the medium and recording the image or the like.

Figure 3:
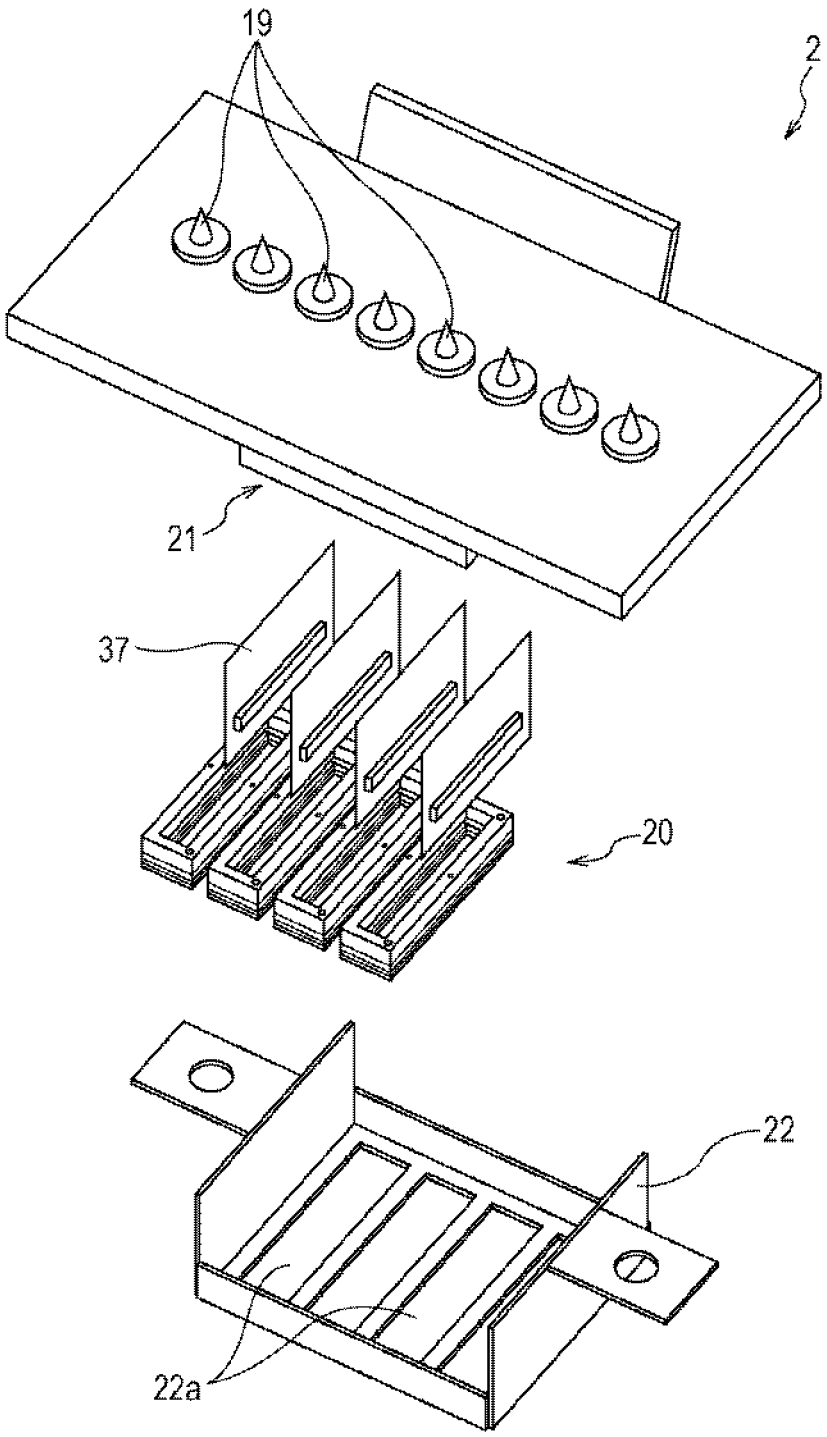
FIG. 3 is an exploded perspective view showing a configuration of an aspect of a liquid ejecting head (recording head).

FIG. 3 is an exploded perspective view showing a configuration of the recording head 2 in the embodiment. The recording head 2 in the embodiment is provided with a head case 21, a plurality of head units 20, and a fixing plate 22 (a type of outer peripheral member). The head case 21 is a box-shaped member that accommodates the head unit 20 and a supply flow path (not shown) supplying ink to the head unit 20. On an upper surface of the head case 21 in this embodiment (the surface opposite to the side where the head unit 20 is fixed), ink introduction needles 19 are arranged side by side along the main scanning direction. The ink introduction needle 19 is a hollow needle-like member and is connected to an ink cartridge (not shown). Ink inside the ink cartridge is introduced from the ink introduction needle 19 into the supply flow path inside the head case 21 and is introduced to each head unit 20 side through the supply flow path. It is not limited to a configuration in which the ink introduction needle 19 is inserted into the ink cartridge, and a configuration in which a porous member provided at a flow path inlet on the head case 21 side and a porous member provided at an ink outlet of the ink cartridge side are brought into contact with each other to exchange ink can be adopted.

In the embodiment, a total of four head units 20 are bonded to the fixing plate 22 on the bottom surface side of the head case 21 in a state where the head units 20 are positioned side by side in the main scanning direction. The fixing plate 22 is a plate material made of metal such as stainless steel, for example. In the fixing plate 22 in the embodiment, an opening portion 22*a* having a shape conforming to the outer shape of the nozzle plate 24 is formed in a state penetrating in the thickness direction at the position corresponding to a nozzle plate 24 (described later) of each head unit 20. Accordingly, the nozzle plates 24 of each head unit 20 fixed to the head case 21 are exposed at the opening portions 22*a*. The fixing plate 22 is fixed to the head case 21 with screws or the like in a state where each head unit 20 is accommodated in the internal space of the head case 21.

Figure 4:
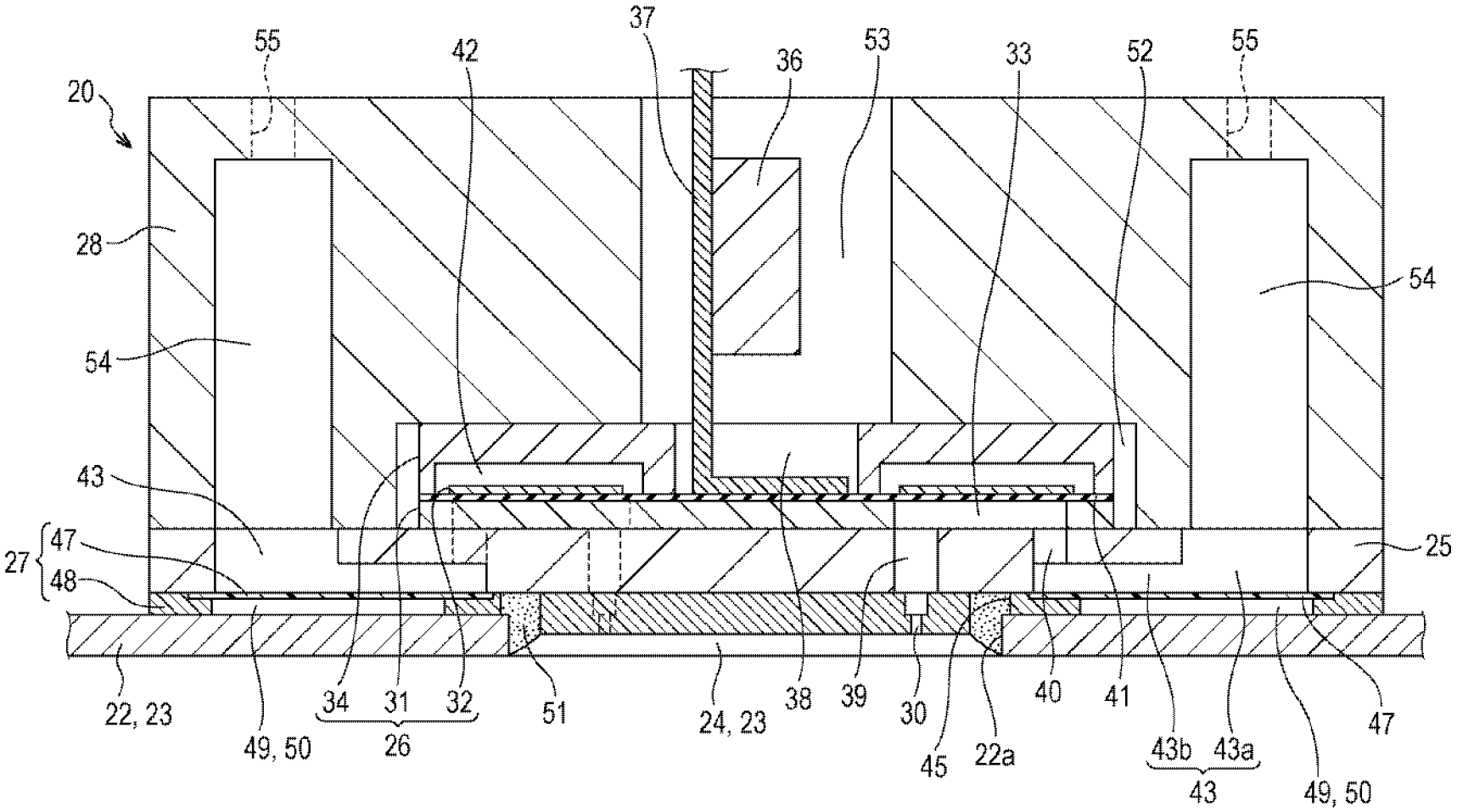
FIG. 4 is a cross-sectional view showing a configuration of an aspect of a head unit.

FIG. 4 is a cross-sectional view showing an example of a configuration of the head unit 20.

The head unit 20 in the embodiment is configured by laminating a plurality of constituent members such as a nozzle plate 24, a communication substrate 25, an actuator unit 26, a compliance substrate 27, a case 28, and bonding these constituent members with an adhesive or the like. In the following description, a laminating direction of the constituent members of the recording head 2 is appropriately described as a vertical direction.

The actuator unit 26 is a unit in which a pressure chamber forming substrate 31 on which a pressure chamber 33 communicating with the nozzle 30 formed in the nozzle plate 24 is formed, a piezoelectric element 32 as an actuator (driving element) that causes a pressure variation in the ink in each pressure chamber 33, and a sealing plate 34 which protects the pressure chamber forming substrate 31 and the piezoelectric element 32 are unitized. A wiring empty portion 38 through which a wiring substrate 37 on which a drive circuit 36 such as a drive IC or the like is mounted is inserted is formed at substantially the center of the sealing plate 34 in a plan view. A lead electrode of the piezoelectric element 32 is disposed in the wiring empty portion 38, and a wiring terminal of the wiring substrate 37 is electrically connected to the lead electrode.

The pressure chamber forming substrate 31 of the actuator unit 26 is made, for example, of a silicon substrate. In the pressure chamber forming substrate 31, a plurality of pressure chambers 33 are provided in rows corresponding to each of the nozzles 30. The pressure chamber 33 is a liquid chamber elongated in a direction intersecting a nozzle row 44 (direction orthogonal to nozzle row 44 in the embodiment), a nozzle communication port 39 communicates with one end portion of the pressure chamber 33 in a longitudinal direction, and a supply port 40 communicates with the other end portion. In the pressure chamber forming substrate 31 in the embodiment, two rows of pressure chambers 33 are formed.

A diaphragm 41 is laminated on the upper surface (surface opposite to a side of the communication substrate 25) of the pressure chamber forming substrate 31, and an upper opening of the pressure chamber 33 is sealed by the diaphragm 41. That is, a portion of the pressure chamber 33 is partitioned by the diaphragm 41. The diaphragm 41 is made of, for example, an elastic film made of silicon dioxide ($SiO_2$) formed on the upper surface of the pressure chamber forming substrate 31, and an insulating film made of zirconium oxide ($ZrO_2$) formed on the elastic film. The piezoelectric elements 32 are laminated on regions corresponding to each of the pressure chambers 33 on the diaphragm 41.

The piezoelectric element 32 of the embodiment is a piezoelectric element with a so-called bending mode. In the piezoelectric element 32, for example, a lower electrode layer, a piezoelectric layer, and an upper electrode layer (any one is not shown) are sequentially laminated on the diaphragm 41. When an electric field corresponding to a potential difference between the both electrodes is applied between the lower electrode layer and the upper electrode layer, the piezoelectric element 32 configured as described above bends and deforms in the vertical direction. In the embodiment, two rows of piezoelectric elements 32 are formed corresponding to the rows of the pressure chambers 33 formed in two rows. The lower electrode layer and the upper electrode layer extend as lead electrodes from the row of the piezoelectric elements 32 on both sides to the inside of the wiring empty portion 38 between the rows and are electrically connected to the wiring substrate 37 as described above.

The sealing plate 34 is laminated on the diaphragm 41 so as to cover the rows of the piezoelectric element 32 formed in two rows. An elongated accommodation space 42 capable of accommodating the rows of the piezoelectric element 32 is formed inside the sealing plate 34. The accommodation space 42 is a hollow formed to the middle of the sealing plate 34 in the height direction from the lower surface side (diaphragm 41 side) toward the upper surface side (case 28 side) of the sealing plate 34. In the sealing plate 34 in the embodiment, the accommodation space 42 is formed on both sides of the wiring empty portion 38.

A communication substrate 25 having an area larger than that of the actuator unit 26 is bonded to a lower surface of the actuator unit 26. The communication substrate 25 is made of a silicon substrate similarly to the pressure chamber forming substrate 31. A nozzle communication port 39 communicating the pressure chamber 33 with the nozzle 30, a common liquid chamber 43 commonly provided for each pressure chamber, and a supply port 40 communicating the common liquid chamber 43 with the pressure chamber 33 are formed in the communication substrate 25 in the embodiment. The common liquid chamber 43 (referred as reservoir or manifold) is a liquid chamber extending along the direction of the nozzle row. As described later, a total of four nozzle rows 44*a* to 44*d* are formed in the nozzle plate 24 in the embodiment according to the ink of each color, and a total of four common liquid chambers 43 are provided in the communication substrate 25 according to each of the nozzle rows 44. Each common liquid chamber 43 is formed of a first liquid chamber 43*a* penetrating the communication substrate 25 in a thickness direction and a second liquid chamber 43*b* formed in a state of being recessed to the middle of the communication substrate 25 in the thickness direction from the lower surface side toward the upper surface side of the communication substrate 25 and leaving a thin plate portion on the upper surface side. In the thin plate portion of the second liquid chamber 43*b*, a plurality of supply ports 40 are formed along the nozzle row direction corresponding to the pressure chambers 33. The supply port 40 communicates with the end portion on the other side in the longitudinal direction of the corresponding pressure chamber 33 (side opposite to the nozzle communication port 39) in a state where the communication substrate 25 and the pressure chamber forming substrate 31 are positioned and bonded to each other.

The nozzle communication port 39 is formed penetrating a position corresponding to each nozzle 30 of the communication substrate 25 in the thickness direction. That is, the nozzle communication port 39 communicates the nozzle 30 and the corresponding pressure chamber 33 between the pressure chamber forming substrate 31 and the nozzle plate 24. A plurality of nozzle communication ports 39 are formed in the nozzle row direction so as to correspond to each of the pressure chambers 33, individually. The nozzle communication port 39 of the embodiment communicates with the end portion of one side of the corresponding pressure chamber 33 (side opposite to the supply port 40) in a state where the communication substrate 25 and the pressure chamber forming substrate 31 are positioned and bonded to each other.

The nozzle plate 24 on which a plurality of nozzles 30 are formed is bonded to a substantially central portion of the lower surface of the communication substrate 25. The nozzle plate 24 in the embodiment is a plate member having a smaller area than that of the communication substrate 25 and the actuator unit 26, and is made of a silicon substrate. The nozzle plate 24 is bonded with the adhesive or the like in a state where these nozzle communication ports 39 and the plurality of nozzles 30 are communicated with each other in a region where a plurality of nozzle communication ports 39 are opened at a position deviated from the opening portion of the common liquid chamber 43 on the lower surface of the communication substrate 25.

Figure 6:
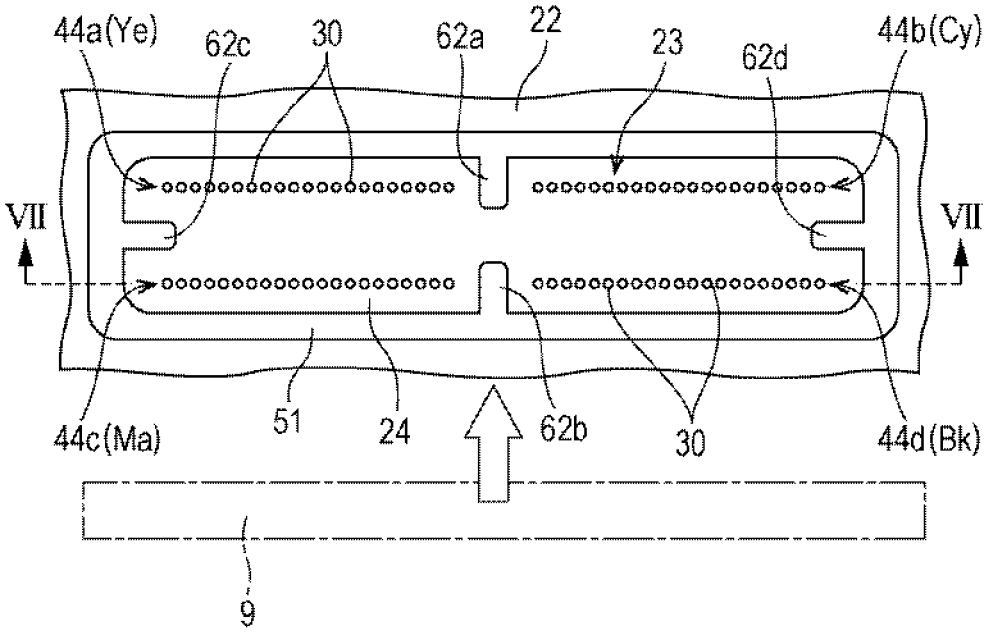
FIG. 6 is a plan view showing a configuration of a nozzle surface.

In the nozzle plate 24 in the embodiment, a total of four nozzle rows 44 (a type of nozzle group in the invention) in which a plurality of nozzles 30 are provided in rows in a sub scanning direction intersecting with the main scanning direction (transport direction of medium) are formed according to the four color inks (refer to FIG. 6). The nozzle plate 24 is made of, for example, a silicon substrate, and a cylindrical shaped nozzle 30 is formed on the substrate by dry etching. In addition, in the embodiment, a surface formed of a surface of the nozzle plate 24 on the side where ink is ejected (surface opposite to a surface to which the communication substrate 25 is bonded) and a lower surface of the fixing plate 22 disposed so as to surround the nozzle plate 24 (surface opposed to the medium or the like in the recording operation) functions as the nozzle surface 23. In addition, as will be described later, the outer periphery of the nozzle plate 24 and a gap between the fixing plate 22 having the opening portion 22*a* surrounding the nozzle plate 24 and the compliance substrate 27 having a through opening 45 similarly surrounding the nozzle plate 24 are filled with a filling material (mold) 51.

Figure 5:
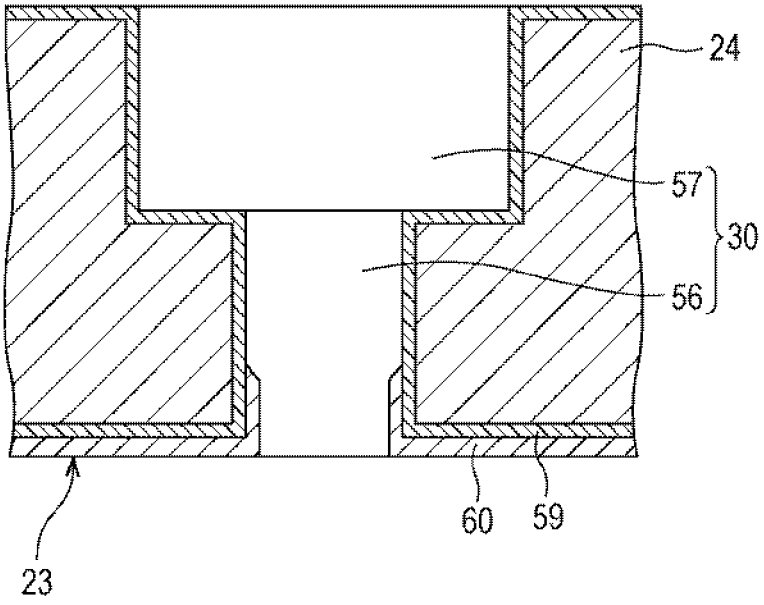
FIG. 5 is a cross-sectional view of a nozzle.

FIG. 5 is a cross-sectional view taken along the direction of the center axis (ink ejecting direction) of the nozzle 30. In the figure, the upper side is the upstream side (pressure chamber 33 side) in the ink ejecting direction and the lower side is the downstream side (medium side in the recording operation) in the ink ejecting direction. The nozzle 30 in the embodiment has a two-stage cylindrical shape by a first nozzle portion 56 on the downstream side and a second nozzle portion 57 on the upstream side, and a flow path cross-sectional area of the first nozzle portion 56 is smaller than a flow path cross-sectional area of the second nozzle portion 57. Both the first nozzle portion 56 and the second nozzle portion 57 have circular shapes in plan view. Ink is ejected from an opening of the first nozzle portion 56 on the side opposite to the second nozzle portion 57 side (that is, nozzle on the nozzle surface 23). The inner diameter of the second nozzle portion 57 may be a tapered shape in which the inner wall surface is inclined so as to enlarge from the downstream side (side of the first nozzle portion 56) to the upstream side (side of the pressure chamber 33).

On the nozzle surface 23 of the nozzle plate 24, a liquid repellent film 60 is formed via a protective film 59. The protective film 59 is formed so as to cover the entire surface of the nozzle plate 24 including the inner wall surface of the nozzle 30 via an oxide film (SiOx) not shown, and is a film for protecting the base material of the nozzle plate 24 from ink. In addition, the protective film 59 also functions as a base film for bonding the base material of the nozzle plate 24 and the protective film 59. The liquid repellent film 60 is a film having a liquid repellent property formed above the protective film 59 in an overlapping manner. The liquid repellent film 60 is formed, for example, by applying a liquid repellent agent (silane coupling agent) containing fluorine. As the liquid repellent agent, a silane compound containing a fluoroalkyl group, for example, trifluoropropyltrimethoxysilane is used. In addition, the liquid repellent film 60 may be formed by a vapor phase growth method such as PVD, CVD, ALD, or the like instead of applying. Similarly, the liquid repellent film is formed on the lower surface functioning as the nozzle surface 23 of the fixing plate 22.

In addition, on the lower surface of the communication substrate 25, the compliance substrate 27 in which the through opening 45 of a shape conforming to the outer shape of the nozzle plate 24 is formed in the center is bonded so as to surround the periphery of the nozzle plate 24. The through opening 45 of the compliance substrate 27 communicates with the opening portion 22*a* of the fixing plate 22, and is configured so that the nozzle plate 24 is disposed inside the opening portion 22*a*. The compliance substrate 27 seals the opening of the common liquid chamber 43 on the lower surface of the communication substrate 25 in a state where the compliance substrate 27 is positioned and bonded to the lower surface of the communication substrate 25. The compliance substrate 27 in the embodiment is configured by bonding a flexible film 47 and a support plate 48 supporting the flexible film 47.

The flexible film 47 of the compliance substrate 27 is bonded to the lower surface of the communication substrate 25 and the flexible film 47 is interposed between the communication substrate 25 and the support plate 48. The flexible film 47 is made of a flexible thin film, for example, a synthetic resin material such as polyphenylene sulfide (PPS). The support plate 48 is formed of a metal material such as stainless steel having higher rigidity and thickness than that of the flexible film 47. A portion of the support plate 48 is removed in a shape conforming to the lower surface opening of the common liquid chamber 43 in a region of the support plate 48 opposed to the common liquid chamber 43. Therefore, the opening on the lower surface side of the common liquid chamber 43 is sealed with only the flexible film 47 having flexibility. In other words, the flexible film 47 partitions a portion of the common liquid chamber 43.

A fixing plate 22 is bonded to the lower surface of the support plate 48. In this manner, a compliance space 50 is formed between the flexible region of the flexible film 47 and the fixing plate 22 opposed thereto. The flexible region of the flexible film 47 in the compliance space 50 is displaced to the common liquid chamber 43 side or the compliance space 50 side in accordance with the pressure fluctuation in the ink flow path, particularly in the common liquid chamber 43.

The actuator unit 26 and the communication substrate 25 are fixed to the case 28. An accommodation empty portion 52 accommodating the actuator unit 26 is formed on the lower surface side of the case 28. The lower surface of the case 28 is sealed by the communication substrate 25 in a state in which the actuator unit 26 is accommodated in the accommodation empty portion 52. An insertion empty portion 53 communicating with the accommodation empty portion 52 is formed in a substantially central portion of the case 28 in plan view. The insertion empty portion 53 also communicates with the wiring empty portion 38 of the actuator unit 26. The wiring substrate 37 is configured to be inserted into the wiring empty portion 38 through the insertion empty portion 53. In addition, inside the case 28, a supply liquid chamber 54 communicating with the common liquid chamber 43 of the communication substrate 25 is formed on both sides of the insertion empty portion 53 and the accommodation empty portion 52. In addition, on the upper surface of the case 28, inlets 55 communicating with each of the supply liquid chambers 54 are opened, respectively. The ink sent from the ink cartridge side is introduced into the inlet 55, the supply liquid chamber 54, and the common liquid chamber 43, and is supplied from the common liquid chamber 43 to each pressure chamber 33 through the supply port 40.

In the recording head 2 having the above configuration, in a state where the inside of the flow path extending from the supply liquid chamber 54 through the common liquid chamber 43 and the pressure chamber 33 to the nozzle 30 is filled with ink, when the piezoelectric element 32 is driven according to the drive signal from the drive circuit 36, a pressure fluctuation occurs in the ink in the pressure chamber 33, and ink is ejected from the predetermined nozzle 30 by the pressure fluctuation.

Figure 7:
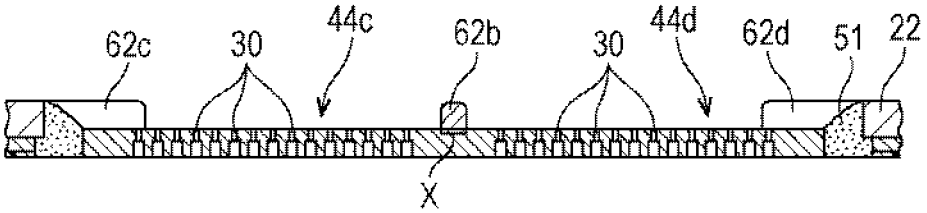
FIG. 7 is a cross-sectional view taken along line VII-VII in FIG. 6.

FIG. 6 is a plan view showing a configuration of a lower surface (nozzle surface 23) of the recording head 2, that is, a configuration of a portion opposed to the medium. In addition, FIG. 7 is a cross-sectional view taken along line VII-VII in FIG. 6. In these figures, one region of the head unit 20 on the lower surface of the recording head 2 is shown. In addition, in FIG. 6, the vertical direction (direction indicated by an arrow in the figure) is the main scanning direction of the recording head 2, and furthermore, it is a wiping direction of the wiper 9 during the wiping operation. A total of four nozzle rows 44*a* to 44*d* are formed in the nozzle plate 24 in the embodiment corresponding to inks of four colors of black (Bk), cyan (Cy), magenta (Ma), and yellow (Ye).

As shown in FIG. 6, each nozzle row 44*a* to 44*d* is formed along a direction (orthogonal to) intersecting with the main scanning direction (sub scanning direction). A first nozzle row 44*a* corresponding to the yellow ink is disposed on the nozzle plate 24 on the downstream side in a wiping direction and closer to one side (left side in FIG. 6) in the sub scanning direction. In addition, a second nozzle row 44*b* corresponding to the cyan ink is similarly disposed on the downstream side in the wiping direction and closer to the other side (right side in FIG. 6) in the sub scanning direction, and the position in the main scanning direction is aligned with the first nozzle row 44*a*. Similarly, a third nozzle row 44*c* corresponding to the magenta ink is disposed on the nozzle plate 24 on the upstream side in the wiping direction and closer to the one side in the sub scanning direction, a fourth nozzle row 44*d* corresponding to the black ink is similarly disposed on the downstream side in the wiping direction and closer to the other side in the sub scanning direction, and the position in the main scanning direction is aligned with the third nozzle row 44*c*. In this manner, the first nozzle row 44*a* corresponding to the yellow ink and the fourth nozzle row 44*d* corresponding to the black ink have diagonal positional relationships in the nozzle plate 24. That is, the first nozzle row 44*a* corresponding to the yellow ink which is the lightest color (highest brightness) and the fourth nozzle row 44*d* similarly corresponding to the black ink which is the darkest color (lowest brightness) among the colors of ink ejected by the recording head 2 are disposed not to be adjacent to each other in a direction where the nozzles 30 are arranged in parallel (in sub scanning direction in the embodiment) and in a direction orthogonal to the direction where the nozzles 30 are arranged in parallel (in main scanning direction in the embodiment) in the nozzle row 44. The brightness of the ink can be based on, for example, the brightness in the L* a* b* color space or the brightness in the Munsell color system.

A gap is generated between the outer periphery of the nozzle plate 24, and the inner periphery of the through opening 45 of the compliance substrate 27, and the inner periphery of the opening 22*a* of the fixing plate 22 in the embodiment. The gap is filled with the filling material 51 to suppress intrusion of ink or the like. As the filling material 51 in the embodiment, an epoxy adhesive is used as described above. Although the filling material 51 has the liquid repellent property, the filling material 51 is lower in the liquid repellent property than the liquid repellent property of the liquid repellent film 60 formed on the surfaces of the nozzle plate 24 and the fixing plate 22, that is, the nozzle surface 23.

Here, since ink (ink droplet) ejected from the nozzle 30 of the recording head 2 is as small as several [ng] to ten and several [ng], as such an ink droplet is ejected, a further minute mist is generated, and such a mist may adhere to the nozzle surface 23 in some cases. In addition, in the cleaning operation of discharging ink from the nozzle 30 in a state where the nozzle surface 23 is sealed by the cap 8, ink adheres to the nozzle surface 23. Although the liquid repellent property of the liquid repellent film 60 and the filling material 51 on the nozzle surface 23 gradually decreases due to aged deterioration, as compared with the liquid repellent property of the liquid repellent film 60, the degree of decrease in the liquid repellent property of the filling material 51 is large. Therefore, the ink adhering to the nozzle surface 23 gathers in the filling material 51 and is likely to spread along the filling material 51. In this manner, in the filling material 51, a mixed color ink (a type of mixed liquid) in which inks of different types (different colors in the embodiment) are mixed is generated. When the wiping operation is performed in the state where such mixed color ink is generated, there is a possibility that the mixed color ink may be rubbed into the nozzle 30 by the wiper 9. When the mixed color ink including the darkest black ink is imprinted in the nozzles 30 corresponding to the lightest yellow ink among the inks handled by the recording head 2, the color mixture is particularly conspicuous, and there is a problem that the image quality of the recorded image or the like is remarkably deteriorated. In order to discharge such mixed ink from the nozzles 30, it is necessary to perform a cleaning operation, and there is a problem that the ink is consumed extra by that amount.

In order to suppress the above problem, even in a case where the liquid repellent property of the filling material 51 is lowered, it is important to make it difficult for the inks to mix with each other in the filling material 51. In view of this point, in the recording head 2 according to the invention, the filling material 51 extends over the nozzle plate 24, and the extended portion is configured to function as an inhibiting portion 62 (corresponding to third region in the invention) which inhibits movement of ink. More specifically, a first inhibiting portion 62*a* is formed between the first nozzle row 44*a* and the second nozzle row 44*b*, and a second inhibiting portion 62*b* is formed between the third nozzle row 44*c* and the fourth nozzle row 44*d*, respectively. The first inhibiting portion 62*a* and the second inhibiting portion 62*b* extend along the main scanning direction from the filling material 51 on the outer side of the nozzle plate 24 toward the center side of the nozzle plate 24 between adjacent nozzle rows 44 in the sub scanning direction (direction where nozzles are arranged in parallel). In addition, in the embodiment, a third inhibiting portion 62*c* is formed between the first nozzle row 44*a* and the third nozzle row 44*c*, and a fourth inhibiting portion 62*d* is formed between the second nozzle row 44*b* and the fourth nozzle row 44*d*, respectively. The third inhibiting portion 62*c* and the fourth inhibiting portion 62*d* extend along the sub scanning direction from the filling material 51 on the outer side of the nozzle plate 24 toward the center side of the nozzle plate 24 between adjacent nozzle rows 44 in the main scanning direction. Each nozzle row 44 is surrounded by the filling material 51 on the outer side of the nozzle plate 24 and the inhibiting portion 62 on the nozzle plate 24. Hereinafter, a region of each nozzle row 44 surrounded by the inhibiting portion 62 and the filling material 51 in the nozzle plate 24 is referred to as a nozzle row region. The nozzle row region corresponds to a nozzle group region in the invention. In addition, a region other than the region where the inhibiting portion 62 is formed on the surface of the nozzle plate 24 (surface opposed to the medium) including the nozzle row region corresponds to a first region in the invention, and the filling material 51 surrounding the periphery of the first region corresponds to a second region in the invention. That is, the filling material 51 as the second region divides the surface of the nozzle plate 24 which is the first region into a plurality of nozzle row regions by the inhibiting portion 62.

The inhibiting portion 62 in the embodiment is formed simultaneously in a step of filling the outer periphery of the nozzle plate 24 and the gap between the inner periphery of the through opening 45 of the compliance substrate 27 and the inner periphery of the opening portion 22*a* of the fixing plate 22 with the filling material 51. Therefore, it is unnecessary to additionally provide a step of forming the inhibiting portion 62. At this time, since the above-described liquid repellent film 60 is formed on the surface of the nozzle plate 24, it is difficult for the inhibiting portion 62 (that is, material of the filling material 51) to be fixed on the liquid repellent film 60 as it is. Therefore, the liquid repellent film 60 of a portion where the inhibiting portion 62 is formed in the nozzle plate 24 (portion indicated by X in FIG. 7) is removed previously by laser irradiation or the like. That is, in the nozzle plate 24, the liquid repellent film 60 is formed in the region corresponding to the first region, whereas the liquid repellent film 60 is not formed in a region corresponding to the inhibiting portion 62 which is a third region. In this manner, in the step of filling the filling material 51, the material of the filling material 51 (epoxy adhesive in the embodiment) can be spread to a formation position of the inhibiting portion 62 on the nozzle plate 24 by the capillary phenomenon and fixed the material. After the fixing, the inhibiting portion 62 is suppressed from falling off from the nozzle plate 24. Since this inhibiting portion 62 protrudes toward the medium side from the surface of the nozzle plate 24, it is a barrier against ink and movement of ink beyond the inhibiting portion 62 is suppressed.

As described above, the configuration in which the filling material 51 adjacent to the nozzle plate 24 has the inhibiting portion 62 is adopted, so that the inhibiting portion 62 inhibits the movement of the ink. Therefore, the ink adhering to the nozzle surface 23 of the recording head 2 is suppressed from moving to the nozzle 30 (nozzle row 44) side. In the embodiment, since the surface of the nozzle plate is divided into a plurality of nozzle row regions corresponding to each nozzle row 44 by the inhibiting portion 62, the movement of ink between the nozzle row regions is suppressed by the inhibiting portion 62. In this manner, since mixed color ink (mixed liquid) in which inks of different colors are mixed in each nozzle row region is suppressed, the mixed color ink is suppressed from rubbing into the nozzle 30 during the wiping operation in which the nozzle surface 23 is wiped by the wiper 9. As a result, it is possible to reduce the amount of ink consumption required for discharging the mixed color ink from the nozzle 30 in the cleaning operation. In addition, in the nozzle plate 24, since the movement path of the inks between the nozzle row regions (movement path along filling material 51) is extended by the outer periphery of the inhibiting portion 62, the movement of ink to the other nozzle row region along the filling material 51 and the inhibiting portion 62 in each nozzle row region is more effectively suppressed.

Furthermore, in the embodiment, the nozzle row region of the first nozzle row 44*a* corresponding to the yellow ink which is the lightest color (highest brightness) and the nozzle row region of the fourth nozzle row 44*d* similarly corresponding to the black ink which is the darkest color (lowest brightness) among the colors of ink ejected by the recording head 2 are disposed not to be adjacent to each other in the direction where the nozzles 30 are arranged in parallel (in sub scanning direction in the embodiment) constituting the nozzle row 44 and in the direction orthogonal to the direction where the nozzles 30 are arranged in parallel (in main scanning direction in the embodiment). In this manner, color mixing of yellow ink and black ink, which is a combination likely to be particularly conspicuous when mixing colors (mixed), is suppressed. In addition, since the nozzle row region of the first nozzle row 44*a* corresponding to the yellow ink is provided at a position away from the filling material 51 on the upstream side in the wiping direction as compared with the nozzle row region of the third nozzle row 44*c*, the risk that the ink attached to the filling material 51 is rubbed by the wiper 9 is reduced. As a result, it is possible to further reduce the amount of ink consumption required for discharging the mixed color ink (mixed liquid) from the nozzle 30 in the cleaning operation.

Regarding the material of the inhibiting portion 62, the same material as the filling material 51 is used in the embodiment, and a compound containing a substituent having a liquid repellent (hydrophobic) property is further applied to the surface of the inhibiting portion 62. As the compound having the liquid repellent property, for example, a hydrocarbon compound or a silicic acid compound having a substituent such as an alkyl group, a halogenated alkyl group, an aryl group, or a halogen can be used. In this manner, since the ink is repelled by the inhibiting portion 62 whose liquid repellent property is enhanced, it is more reliably suppressed that the ink moves beyond the inhibiting portion 62 to the other nozzle row region. It is preferable that the liquid repellent property of the inhibiting portion 62 be higher than the liquid repellent property of the other portion of the filling material 51 and lower than the liquid repellent property of the liquid repellent film 60 on the nozzle plate 24 (nozzle surface 23). In this manner, the ink on the filling material 51 side is suppressed from moving toward the nozzle 30 side of the nozzle plate 24 while suppressing the movement of the ink due to the liquid repellent property of the inhibiting portion 62. In addition, the step of forming the inhibiting portion 62 may be performed separately from the step of filling the filling material 51. That is, after the step of filling the filling material 51, the step of forming the inhibiting portion 62 may be performed through a step of removing the liquid repellent film 60 in the nozzle plate 24.

In the embodiment, although the configuration in which the inhibiting portions 62*a* to 62*d* are formed between each of the nozzle rows 44, that is, between the adjacent nozzle row regions is exemplified, the inhibiting portion 62 may not necessarily be provided between all the nozzle row regions, and the inhibiting portion 62 may be provided between the nozzle row regions to which at least ink which is desired to suppress color mixing is assigned.

Figure 8:
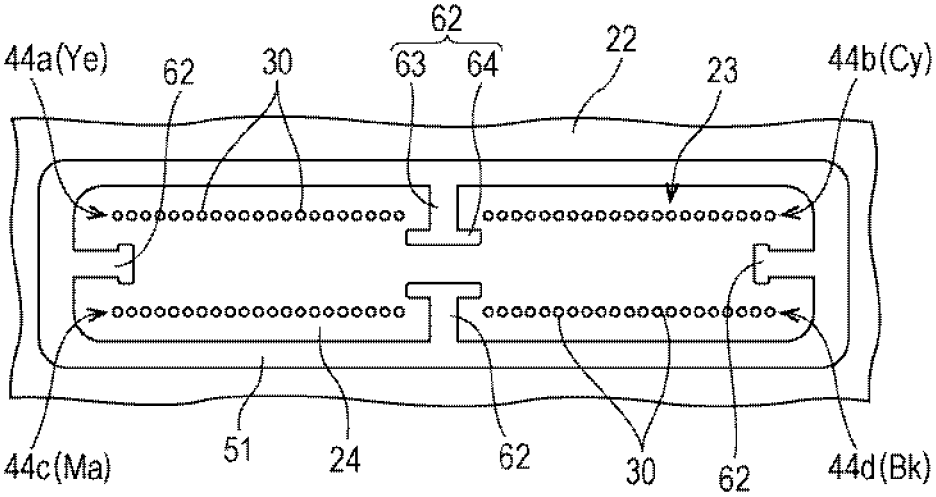
FIG. 8 is a plan view showing a configuration of a nozzle surface according to a second embodiment.

FIG. 8 is a plan view showing a configuration of a lower surface (nozzle surface 23) of a recording head 2 according to a second embodiment of the invention. Regarding the inhibiting portion 62, it is not limited to the aspect exemplified in the first embodiment, and various aspects can be adopted. In the inhibiting portion 62 in the second embodiment shown in FIG. 8, a base portion 63 extending from the filling material 51 on the outer peripheral side of the nozzle plate 24 toward the center side of the nozzle plate 24 and a leading end portion 64 from the tip end of the base portion 63 toward both sides in a direction orthogonal to the base portion 63 are extended respectively. Even if the ink in a certain nozzle row region moves along the filling material 51 toward the adjacent nozzle row regions with the inhibiting portion 62 interposed therebetween, the leading end portion 64 of the inhibiting portion 62 functions as a return to the moving direction of the ink and the moving direction is changed to a side opposite to the adjacent nozzle row region side. By providing the leading end portion 64 in the inhibiting portion 62 in this manner, the ink is unlikely to move along the inhibiting portion 62. In addition, by providing the leading end portion 64 in the inhibiting portion 62, since the movement path of the inks between the nozzle row regions can be further lengthened, the movement of the ink to the other nozzle row region along the filling material 51 and the inhibiting portion 62 can be more effectively suppressed. Other configurations are the same as those in the first embodiment.

Figure 9:
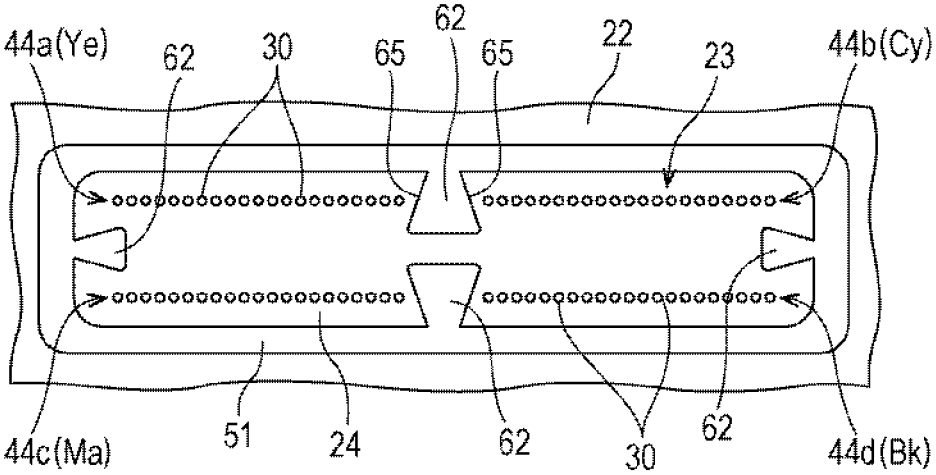
FIG. 9 is a plan view showing a configuration of a nozzle surface according to a third embodiment.

FIG. 9 is a plan view showing a configuration of a lower surface (nozzle surface 23) of a recording head 2 according to a third embodiment of the invention. The inhibiting portion 62 in the embodiment has a shape such that the width thereof increases as the inhibiting portion 62 approaches the center side of the nozzle plate 24 from the filling material 51 on the outer peripheral side of the nozzle plate 24. In this manner, the inhibiting portion 62 has inclined surfaces 65 on both sides. Similarly to the leading end portion 64 in the second embodiment, the inclined surface 65 functions as a return to the moving direction of the ink, and the moving direction is changed to a side away from the adjacent nozzle row region. Therefore, the ink is unlikely to move to the adjacent nozzle row region along the inhibiting portion 62. In addition, by providing the inclined surface 65 in the inhibiting portion 62, since the movement path of the inks between the nozzle row regions can be further lengthened, the movement of the ink to the other nozzle row region along the filling material 51 and the inhibiting portion 62 can be more effectively suppressed in this manner. Other configurations are the same as those in the first embodiment.

Figure 10:
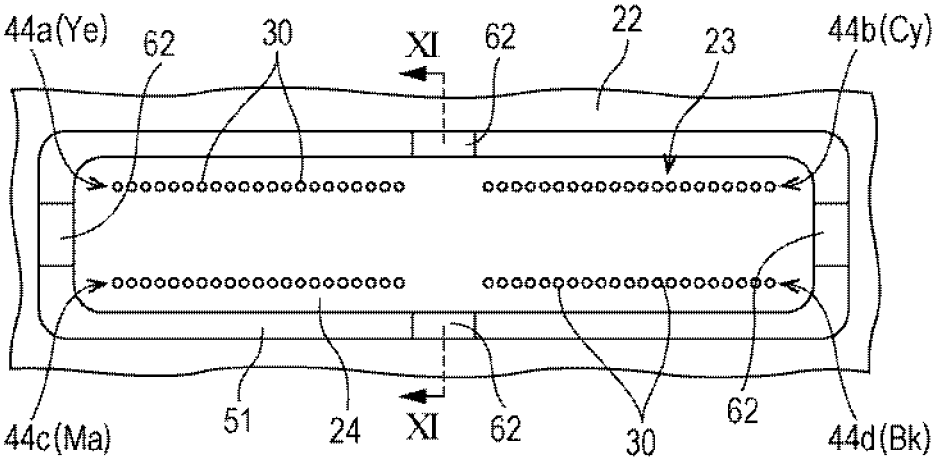
FIG. 10 is a plan view showing a configuration of a nozzle surface according to a fourth embodiment.
Figure 11:
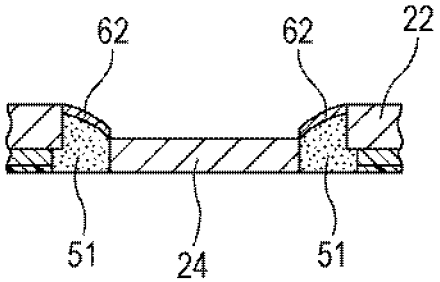
FIG. 11 is a cross-sectional view taken along line XI-XI in FIG. 10.

FIG. 10 is a plan view showing a configuration of a lower surface (nozzle surface 23) of a recording head 2 according to a fourth embodiment of the invention. In addition, FIG. 11 is a cross-sectional view taken along line XI-XI in FIG. 10. The inhibiting portion 62 in the embodiment is formed by over-coating the material of the filling material 51 on a portion corresponding to each nozzle row region on the filling material 51 on the outer peripheral side of the nozzle plate 24. The material of the filling material 51 to be over-coated further contains additives for suppressing aged deterioration of the filling material 51. That is, for example, a material in which a compound having the above liquid repellent property, a heat resistant such as an antioxidant, or a light resistant (light stabilizer) such as an ultraviolet absorber is added to the epoxy adhesive is used as the material of the inhibiting portion 62. The thickness of a portion provided with the inhibiting portion 62 is thicker than the thickness of the other portion of the filling material 51. In this configuration, the ink is unlikely to move to the adjacent nozzle row region along the inhibiting portion 62. In addition, since the aged deterioration of the inhibiting portion 62 is suppressed by containing the above additive, color mixing of inks can be suppressed for a long time. The inhibiting portion 62 is not limited to only on the filling material 51 and may extend on the surface of the nozzle plate 24. In this case, the liquid repellent film 60 in the portion where the inhibiting portion 62 is provided is previously removed, so that the inhibiting portion 62 can be formed and fixed on the surface of the nozzle plate 24. In addition, other configurations are the same as those in the first embodiment.

Figure 12:
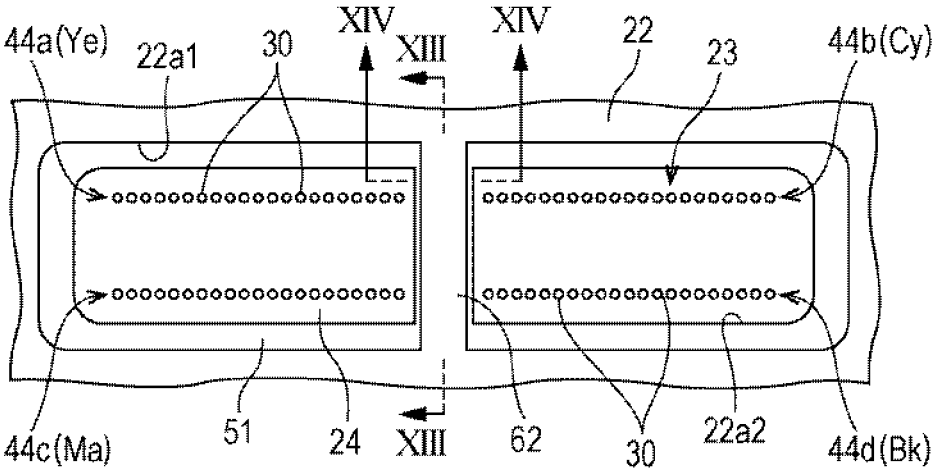
FIG. 12 is a plan view showing a configuration of a nozzle surface according to a fifth embodiment.
Figure 13:
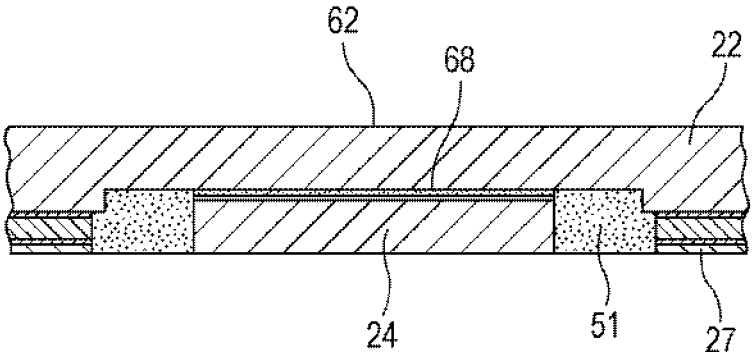
FIG. 13 is a cross-sectional view taken along line XIII-XIII in FIG. 12.
Figure 14:
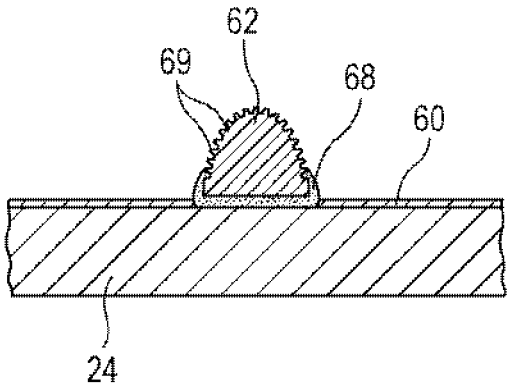
FIG. 14 is a cross-sectional view taken along line XIV-XIV in FIG. 12.

FIG. 12 is a plan view showing a configuration of a lower surface (nozzle surface 23) of a recording head 2 according to a fifth embodiment of the invention. In addition, FIG. 13 is a cross-sectional view taken along line XIII-XIII in FIG. 12 and FIG. 14 is a cross-sectional view taken along line XIV-XIV in FIG. 12. The inhibiting portion 62 in the embodiment is different from each of the above embodiments in that the beam-like inhibiting portion 62 crossing the opening portion 22*a* from the fixing plate 22 on the outer peripheral side of the nozzle plate 24 extends on the surface of the nozzle plate 24. That is, in the embodiment, the fixing plate 22 corresponds to the second region in the invention. The inhibiting portion 62 is formed in series between the nozzle row region of the third nozzle row 44*c* and the nozzle row region of the fourth nozzle row 44*d* from between the nozzle row region of the first nozzle row 44*a* and the nozzle row region of the second nozzle row 44*b*, and the opening portion 22*a* of the fixing plate 22 is divided into two opening portions 22*a* and 22*b* by the inhibiting portion 62.

In addition, as shown in FIGS. 13 and 14, the inhibiting portion 62 is fixed to the surface of the nozzle plate 24 with the adhesive 68. In addition, as shown in FIG. 14, the adhesive 68 extends from a bonding region between the inhibiting portion 62 and the nozzle plate to the outside of the bonding region. That is, the adhesive 68 protrudes outward from the bonding region between the inhibiting portion 62 and the nozzle plate, and continues to the side surface of the inhibiting portion 62. In this manner, it is more reliably suppressed that the ink passes through the bonding region between the inhibiting portion 62 and the nozzle plate 24. In addition, since surface roughening is performed on the surface of the inhibiting portion 62 in the embodiment, so that fine unevenness 69 is formed. In this manner, a contact angle (static contact angle) when the ink adheres to the inhibiting portion 62 is increased, and the liquid repellent property is further enhanced. In this manner, it is more reliably suppressed that the ink moves beyond the inhibiting portion 62 to another nozzle group region. By further extending the beam-like portion from the fixing plate 22 from between the nozzle row region of the first nozzle row 44*a* and the nozzle row region of the fourth nozzle row 44*c* to the nozzle row region of the second nozzle row 44*b* and the nozzle row region of the fourth nozzle row 44*d*, it is also possible to adopt a configuration in which the inhibiting portion 62 in a state where the beam-like portions cross longitudinally and transversely at the center portion is provided in the opening portion 22*a* of the fixing plate 22. In this case, the opening portion 22*a* of the fixing plate 22 is divided into four opening portions corresponding to the respective nozzle row regions by the inhibiting portion 62. In this manner, since each nozzle row region is an independent region, the movement of ink between the nozzle row regions is more reliably suppressed. In addition, other configurations are the same as those in the first embodiment.

Figure 15:
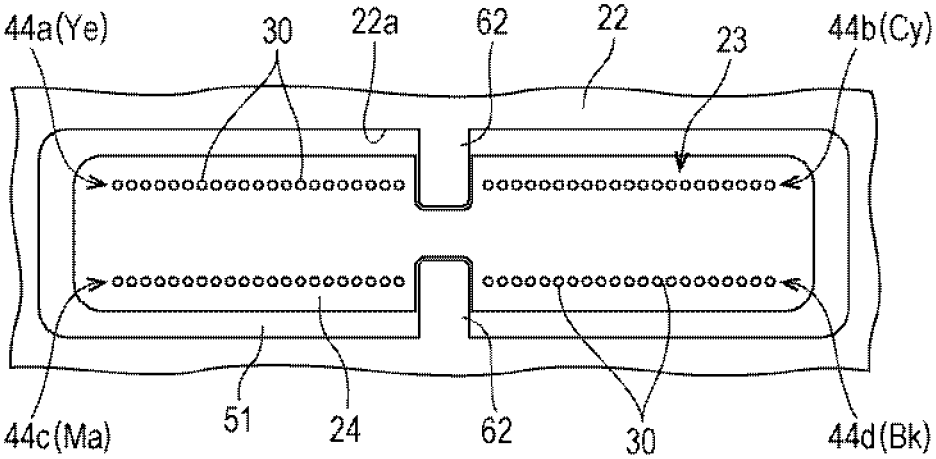
FIG. 15 is a plan view showing a configuration of a nozzle surface according to a modified example of the fifth embodiment.

FIG. 15 is a plan view showing a configuration of a lower surface (nozzle surface 23) of a recording head 2 according to a modified example of the fifth embodiment. In the above fifth embodiment, although the inhibiting portion 62 has a beam shape which is divided into two opening portions crossing the opening portion 22*a* from the fixing plate 22 on the outer peripheral side of the nozzle plate 24, there is a possibility that the ink moves to the other nozzle row region in the same opening portion of the fixing plate 22 along the beam-like inhibiting portion 62. Therefore, in the modified example, the inhibiting portion 62 has a shape discontinued in the middle without crossing the opening portion 22*a*. That is, between the nozzle row region of the first nozzle row 44*a* and the nozzle row region of the second nozzle row 44*b*, and between the nozzle row region of the third nozzle row 44*c* and the nozzle row region of the fourth nozzle row 44*d*, the inhibiting portions 62 extend with a length so as not to come into contact with each other from the fixing plate 22 on the outer side of the nozzle plate 24 toward the center side of the nozzle plate 24. In this manner, it is more preferable that the movement of the ink to the other nozzle row region along the inhibiting portion 62 be suppressed. Such an inhibiting portion 62 may be provided between the nozzle row region of the first nozzle row 44*a* and the nozzle row region of the fourth nozzle row 44*c*, and between the nozzle row region of the second nozzle row 44*b* and the nozzle row region of the fourth nozzle row 44*d*, respectively.

Hereinbefore, although the example in which the invention is applied to the configuration that wipes the nozzle surface 23 of the recording head 2 of the printer 1 has been described, the invention is not limited thereto. The invention can also be applied to a nozzle surface such as a color material ejecting head used for manufacturing a color filter such as a liquid crystal display, an electrode material ejecting head used for forming an electrode such as an organic electro luminescence (EL) display and an field emission display (FED), a bioorganic ejecting head used for manufacturing a bio chip (biochemical element), or the like as long as it is configured to wipe the nozzle surface of the liquid ejecting head that discharges the liquid with the wiping member.

The entire disclosure of Japanese Patent Application No. 2017-206900, filed Oct. 26, 2017 is expressly incorporated by reference herein.

What is claimed is:

1. A liquid ejecting head in which a plurality of nozzles ejecting a liquid toward a medium are arranged in parallel, the head comprising:

a first region including the plurality of nozzles and a second region surrounding the first region, the first and second regions being provided in a portion of the liquid ejecting head opposed to the medium;

a nozzle plate on which the plurality of nozzles are arranged in parallel; and an outer peripheral member surrounding the nozzle plate, wherein the second region has an inhibiting portion inhibiting a movement of the liquid, wherein the second region is a filling material filled in a gap between the nozzle plate and the outer peripheral member, and the inhibiting portion is a portion of the filling material extending from an outside of the nozzle plate to the first region of the nozzle plate.

2. The liquid ejecting head according to claim 1, wherein the first region has a plurality of nozzle groups corresponding to each of a plurality of different liquids, and is divided into a plurality of nozzle group regions including the nozzle groups by the inhibiting portion.

3. The liquid ejecting head according to claim 2, wherein each of the nozzle groups is assigned with each of the liquids having different brightness among the plurality of different liquids, and among the plurality of nozzle group regions, the nozzle group region which includes the nozzle group corresponding to the liquid having a highest brightness and the nozzle group region which includes the nozzle group corresponding to the liquid having a lowest brightness are not adjacent to each other in a first direction where the nozzles are arranged in parallel and in a second direction orthogonal to the first direction.

4. The liquid ejecting head according to claim 2, wherein the inhibiting portion is located between adjacent nozzle group regions.

5. The liquid ejecting head according to claim 2, wherein the inhibiting portion is located between adjacent nozzle group regions and protrudes toward the medium side from the first region.

6. The liquid ejecting head according to claim 5, wherein the inhibiting portion has a liquid repellent property.

7. A liquid ejecting apparatus comprising:

the liquid ejecting head according to claim 6; and a wiping mechanism that wipes a portion of the liquid ejecting head opposed to the medium.

8. The liquid ejecting head according to claim 1, wherein the inhibiting portion protrudes toward the medium side from the first region.

9. The liquid ejecting head according to claim 1, wherein the inhibiting portion has a liquid repellent property.

10. The liquid ejecting head according to claim 9, wherein the liquid repellent property of the inhibiting portion is higher than a liquid repellent property of the second region and lower than a liquid repellent property of the first region.

11. A liquid ejecting apparatus comprising:

the liquid ejecting head according to claim 1; and a wiping mechanism wiping a portion of the liquid ejecting head opposed to the medium.

12. A liquid ejecting head in which a plurality of nozzles ejecting a liquid toward a medium are arranged in parallel, the head comprising:

a first region including the plurality of nozzles and a second region surrounding the first region, the first and second regions being provided in a portion of the liquid ejecting head opposed to the medium;

a nozzle plate on which the plurality of nozzles are arranged in parallel; and an outer peripheral member surrounding the nozzle plate, wherein the second region has an inhibiting portion inhibiting a movement of the liquid, wherein the second region is a filling material filled in a gap between the nozzle plate and the outer peripheral member, and the inhibiting portion is a portion of the filling material extending from an outside of the nozzle plate to the first region of the nozzle plate and has a liquid repellent property.

* * * * *